US008925238B2

(12) United States Patent
Anderson

(10) Patent No.: US 8,925,238 B2
(45) Date of Patent: Jan. 6, 2015

(54) FIREARM SIGHT

(71) Applicant: Norman L. Anderson, Knoxville, TN (US)

(72) Inventor: Norman L. Anderson, Knoxville, TN (US)

( * ) Notice: Subject to any disclaimer, the term of this patent is extended or adjusted under 35 U.S.C. 154(b) by 139 days.

(21) Appl. No.: 13/853,558

(22) Filed: Mar. 29, 2013

(65) Prior Publication Data

US 2014/0123537 A1 May 8, 2014

Related U.S. Application Data

(60) Provisional application No. 61/617,310, filed on Mar. 29, 2012.

(51) Int. Cl.

| | |
|---|---|
| ***F41G 1/00*** | (2006.01) |
| ***F41G 1/34*** | (2006.01) |
| ***F41G 1/08*** | (2006.01) |
| ***F41G 1/12*** | (2006.01) |
| ***F41G 1/16*** | (2006.01) |

(52) U.S. Cl.

CPC *F41G 1/345* (2013.01); *F41G 1/08* (2013.01); *F41G 1/12* (2013.01); *F41G 1/16* (2013.01)

USPC ..... 42/132; 42/114

(58) Field of Classification Search

CPC ... F41G 11/003; F41G 11/004; F41G 11/001; F41G 1/387

USPC ..... 42/111–148

See application file for complete search history.

(56) References Cited

U.S. PATENT DOCUMENTS

| | | | | |
|---|---|---|---|---|
| 3,750,318 | A * | 8/1973 | Burris | 42/127 |
| 4,627,171 | A * | 12/1986 | Dudney | 42/123 |
| 5,528,418 | A | 6/1996 | Bowman, Jr. | |
| 5,724,761 | A | 3/1998 | Bergacker | |
| 5,836,100 | A | 11/1998 | Stover | |
| 5,924,234 | A * | 7/1999 | Bindon et al. | 42/123 |
| 6,035,539 | A | 3/2000 | Hollenbach et al. | |
| 6,477,780 | B2 * | 11/2002 | Aldred | 33/265 |
| 6,519,889 | B1 | 2/2003 | Schlierbach et al. | |
| 7,503,321 | B2 * | 3/2009 | Afshari | 124/87 |
| 7,730,655 | B2 * | 6/2010 | Spuhr | 42/127 |
| 7,739,825 | B2 * | 6/2010 | LoRocco | 42/132 |
| 7,946,074 | B2 * | 5/2011 | Nemec | 42/137 |
| 8,375,619 | B2 | 2/2013 | Hewes | |
| 8,505,228 | B2 * | 8/2013 | Cheng | 42/90 |
| 2001/0027620 | A1 * | 10/2001 | Wooten et al. | 42/124 |
| 2003/0079396 | A1 | 5/2003 | Brown et al. | |
| 2005/0241212 | A1 * | 11/2005 | Swan | 42/127 |
| 2011/0271576 | A1 * | 11/2011 | Jahromi | 42/122 |
| 2013/0180155 | A1 * | 7/2013 | He et al. | 42/124 |
| 2014/0041277 | A1 * | 2/2014 | Hamilton | 42/122 |

* cited by examiner

*Primary Examiner* — Samir Abdosh

(74) *Attorney, Agent, or Firm* — George W. Moxon, II; Brian P. Harrod

(57) ABSTRACT

A firearm sight comprising a generally circular sight support ring surrounding and removably holding an optically clear generally circular lens, said lens having a cylindrical shape, front and back faces, a diameter greater than the thickness of the lens, and a scintillating fiber optic member centrally embedded within said circular lens, a means for mounting said circular sight support ring to a firearm, and a means of adjusting said circular support ring in relation to said means for mounting said ring to a firearm.

15 Claims, 2 Drawing Sheets

FIREARM SIGHT

BACKGROUND OF THE INVENTION

The present invention relates to an aiming device, or sight, for a firearm. Specifically, it describes a simple, effective, passively illuminated, non-telescopic sight requiring no power source.

Proper sights on firearms are essential for accurate shooting. The firearm, such as a rifle or shotgun, can be inherently very accurate due to its design and manufacture. Yet if the sights on the firearm are not effective, the firearm will not accurately hit targets. It is important to bear in mind, of course, that some sights are easier to use by some shooters than others.

Typically, firearms will have both a front sight, located on the firearm barrel near the muzzle of the barrel, and a rear sight, located near the rear or breech end of the barrel or on the receiver or breech portion of the firearm. These sights are commonly referred to as iron sights. In order to shoot the firearm accurately, the shooter must line up the front sight and the rear sight, and then line the sights up with the intended target. This takes a large amount of practice to do properly and even then this sighting process takes time and hence does not lend itself well to shooting at moving targets or to shooting rapidly. Traditional iron sights often use a post as a front sight. One problem associated with this arrangement is the post type front sight covers the target, obscures the field of view, and confuses point of aim.

Some of the problems associated with iron sights were addressed by telescopic sights that have reticles and optics, which usually provide magnification, located within a tube that is mounted above the breech end of the firearm that could be the rear portion of the barrel or the firearm receiver. With a telescopic sight it is not necessary to align two sights on the firearm. Instead, it is only necessary to place the reticle on the target. However, the telescopic sight requires a mount for mounting the telescope to the firearm and a telescope mount creates other problems.

The telescope and its mount obviously add weight to the firearm, but more importantly it raises the line of sight higher and farther away from the firearm barrel bore axis than with standard iron sights. This causes several problems. First, with rifles and shotguns, the higher line of sight means that the shooter's head must be higher on the stock of the firearm to be able to properly sight through the telescope. This means that the stock must have a cheek rest that is properly positioned to raise the shooter's head enough to properly sight through the telescope. In many cases this will mean that the standard or factory stock will have to be replaced and the shooter incurs the associated expense and inconvenience. In addition, for both rifles and shotguns and other such small arms firearms, the higher line of sight above the bore axis means that it is more difficult to adjust the sight for shooting at a variety of ranges with one sight setting or even with minor adjustments. Also, the higher line of sight means that movement or rotation of the rifle, shotgun, or other small firearm will result in greater inaccuracy than would be the case if iron sights were used.

Another problem with a telescopic sight is that it may strike the eye of the shooter when the firearm recoils if it is not properly mounted for that shooter. While use of a telescopic sight magnifies the view of the target, it also reduces the shooter's peripheral vision.

Another approach to sights for rifles includes what are often referred to as "red dot sights," which use a battery-powered LED, or other means, to project a red dot or reticle onto an angled piece of glass, plastic or similar transparent reflective material. The dot or reticle replaces the traditional iron sights and indicates the target, and facilitates aiming the gun. As with any battery-operated device, these types of sights are susceptible to loss of power, whether due to expiration of battery life, damage, or conventional wear-and-tear. Unpowered, these types of sights are of limited or no use.

While these approaches have been beneficial to sighting and sights for firearms, there continues to be a need for simple, quick, effective sights.

SUMMARY OF THE INVENTION

The present invention is directed to a device to be used as a sight as well as a forward reference point in an alignment system on a barrel of a firearm, such as a rifle. While the primary focus of the invention is use with rifles or rifled barrels, smoothbore barrels, such as shotguns or similar firearms, are equally suitable. The device could also be used with smaller firearms, such as pistols, carbines, or submachine-guns.

The device uses a transparent, optically clear lens which removably holds a fiber optic rod. The lens is removably fixed inside a metal ring, and allows the user to see a visibly bright sighting point without disrupting the larger field of view and visual of the entire target. The ring is preferably threaded into a base to allow for adjustments to be made to zero the rifle and may be locked in position by one or more ball-detents using thumbscrews to secure. The ring, preferably, is symmetrical to appear identical from either side. The threaded base for mounting of the ring is subject to barrel dimensions and diameters based on the firearm. The weight of the sight is negligible and does not adversely affect weapon balance or hinder proper aiming.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF THE INVENTION

Figure 1:
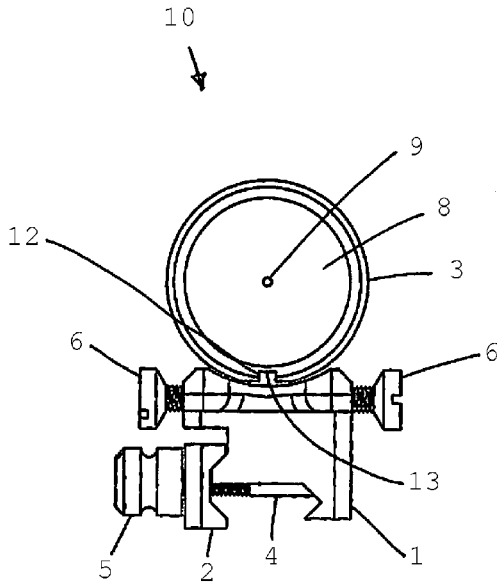
FIG. 1 is a front view of a sight in accordance with the present invention.
Figure 2:
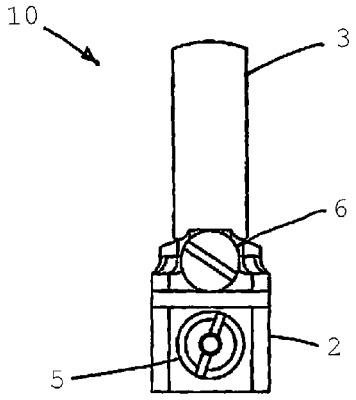
FIG. 2 is a side view of the sight shown in FIG. 1.
Figure 3:
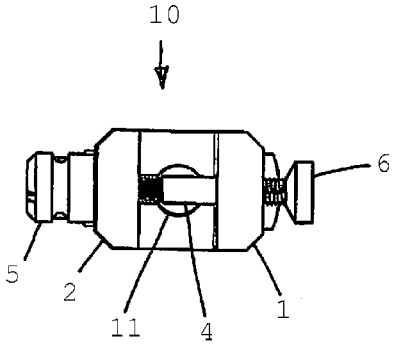
FIG. 3 is a bottom view of the sight shown in FIG. 1.

The present invention generally relates to a device to be used as a sight or as forward reference point in an alignment or targeting system on a firearm barrel, whether rifled or smoothbore. The sight 10 uses a support ring 3 to hold removably an optically clear, transparent lens 8, which holds a fiber optic member or rod 9. In other words, the fiber optic member 9 is embedded within an annular lens 8, which is surrounded by an annular ring 3; the lens 8 is removable. The lens 8 has identical front and back faces and is generally flat, and is optically neutral. The lens need not be perfectly flat, it can have slight curvature or variation. The lens 8 can be curved to magnify or refract light, but flat and optically neutral is preferred. In an alternate embodiment, the fiber optic member 9 is also removable. This arrangement allows the user to see a visibly bright sighting point while providing a larger field of view and a visual of the entire target. The ring 3 is symmetrical to appear identical from either side. The composition of the ring 3 is not critical, so long it is strong enough and flexible enough to maintain its shape and tolerances. The preferred embodiment is metal, specifically, aluminum, but it could also be constructed out of other rigid, durable materials, such as carbon fiber, or any number of polymers or combinations of polymers.

The ring 3 is connected to a threaded sight screw 7 via one or more alignment ring slots 13 on the ring 3 and one or more corresponding mating ridges 12 on the sight screw 7. These slots 13 and ridges 12 are important for proper alignment of the sight 10. The exact connection between slot 13 and ridge 12 is not critical. Ridge 12 can be joined with slot 13 using an adhesive, chemical bonding or via welding. In addition, the connection can made using a dovetail joint, held in place by friction, adhesive, chemical bonding or welding. In another embodiment (not shown), the ring 3 and sight screw 7 are produced as a single piece, with the need to join being moot. Such an alternate embodiment might be disfavored due to costs and complications associated with manufacturing the device as a single component.

The sight may include a hinge to allow the ring to be folded down for transportation, storage/stowed, or convenience, and flipped up for use. The sight can be locked in place, in both the upright position and down (folded) position. The folding mechanism can be any known in the art. One example is U.S. Pat. No. 8,375,619 to Hewes, which is herein incorporated by reference. Other examples include various folding sights such as those available from and/or manufactured by TROY® Industries.

The sight screw 7 threads into and connects to base 1 to allow for adjustments to be made to zero the rifle. It is held in position by a plurality of ball-detents (not shown), which fit into channel 15 and is further locked into position using thumbscrews 6. As used herein, "ball detent" means a simple mechanical arrangement used to hold a moving part in a temporarily fixed position relative to another part. The ball is a single, usually metal sphere or ball bearing, sliding within a bored cylinder, against the pressure of a spring. The spring pushes the ball against the other part of the mechanism, which carries the detent, which can be as simple as a hole of smaller diameter than the ball. When the hole is in line with the cylinder, the ball falls partially into the hole under spring pressure, holding the parts at that position. Additional force applied to the moving parts will push the ball back into its cylinder, compressing the spring, and allowing the parts to move to another position.

The sight clamp base 1 is not critical to the design of the present invention. The means of securing the sight to the rifle could entail use of a quick-release mechanism (not shown) known in the industry. The sight 10 is mounted on top of the barrel of a rifle, shotgun or other firearm (not shown). The sight 10 is mounted at the muzzle end, near the exit of the barrel.

The ring 3 is generally circular. The ring 3 can be any regular polygonal, oval or elliptical shape. The same holds true for the sight lens 8; it is likewise generally circular, but can be any regular polygonal, oval or elliptical shape. However, a circle is preferred in both cases as its uniform shape reduces distractions to the shooter's eye. Moreover, a fiber optic member 9 mounted at the center, or focus, of a circular lens 8 provides an equal field of view around the fiber optic rod 9, which improves overall aim. Ease of manufacture also suggests a preference for a circular ring and lens.

While the preferred embodiment of the ring 3 is a complete circle, other shapes are possible. The ring 3 could be a semi-circular Y or wishbone shape. This shape would hold the lens 8 via friction and would allow for easier removal of the lens 8. However, this shape is prone to fatigue or wear over prolonged use. This fatigue would cause the sight 10 to lose its ability to securely hold the lens 8 over time.

The lens 8 is a cylinder with a diameter greater than its thickness or length; it is in the shape of a disc. The optically clear lens is replaceable at the user level to allow for replacement with a tinted lens to optimize visual clarity in various light conditions. Also replaceable in one embodiment is the fiber-optic rod to allow for greater contrast against target. Each component of this device is designed to be replaceable without the use of tools for ease of user maintenance and suitability. The lens can be replaced with a variety of tinted lenses. Such replacement lens options allow the user to optimize visual clarity in various light conditions. As an example, many shooters show a preference for yellow tinted shooting glasses or goggles. The present invention would allow the shooter to replace the clear, colorless lens with a yellow-tinted lens, thus mimicking the tint of shooting glasses. Any variety of colored lenses could be so employed; the choice is purely up to the shooter. The composition of the lens is not critical and could be of any number of compositions known in the industry, including but not limited to plastics or polymers such as acrylic or polycarbonate, or glass such as tempered glass. Other possible compositions include extra low dispersion glass, commonly referred to as "ED glass," found in high-end rifle scopes, or proprietary products such as Corning's Gorilla Glass, used in electronic devices. Acrylic is preferred due its ready availability, low manufacturing costs, desired physical properties, and the ability to obtain it in optically clear grades.

The fiber optic member 9 is generally cylindrical with a diameter less than its thickness or length; it is in the shape of a rod or column. It has scintillating properties and is passively illuminated via ambient light sources, usually sunlight or indoor lighting; however, any ambient light source will suffice. The fiber optic rod 9 may be either flush with the lens 8 or sit proud of the lens 8. In the case of sitting proud of the lens 8, the ends of the rod 9 may be either cut perpendicular to the axis, rounded off, cut at an angle or cut in a cone shape to catch more ambient light. The preferred embodiment comprises a rounded, or semi-hemispheric, end, as it appears to catch and emit a more light; however, the exact radius of the rounded end is not critical. The rod 9 can extend beyond the faces of the lens 8 symmetrically or asymmetrically. Neither arrangement is critical; however symmetrically is the preferred embodiment.

In one embodiment, the present invention also allows for replacement of the fiber-optic rod 9. The rod 9 can be temporarily held in place via friction and can be simply slid out and replaced with another rod. The lens 8 would hold the rod 9 with sufficient frictional force that the rod 9 would stay in place indefinitely. This replacement is likewise the shooter's preference, and would provide greater contrast against target. For example, using a red rod while shooting at a red target, a colorless target with a red bulls-eye, or game in red, autumnal foliage could prove difficult and confusing. In such a situation, the shooter could easily swap the red rod for another color, such as green fiber optic rod. Each component of this device is designed to be replaceable without the use of tools for ease of user maintenance and suitability. However, the fiber optic rods 9 are small, and can easily be lost. In addition, to allow for replacement of the rod 9 would require tighter tolerances in producing the hole in the lens 8. This would lead to increased manufacture costs. Permanently affixing the rod 9 to the lens 8 using an adhesive would lower the required tolerances in manufacturing the lens 8, which would reduce the cost. Lowering the tolerances without using an adhesive could result in the hole in the lens 8 being too large and the rod 9 being held too loosely, resulting in the rod 9 slipping or falling out of the lens 8 and getting lost. The preferred embodiment, therefore, comprises affixing the rod 9 to the lens 8 permanently using an adhesive. The rod and lens combination is then replaced as a whole, single unit.

Due to the physical properties of fiber optic 9, namely its light-gathering, scintillating nature, there is no need for a backup power source. Most "red dot" type sights use a battery-powered LED to project a red dot or reticle onto an angled piece of glass, plastic or similar transparent reflective material. The dot or reticle replaces the traditional iron sights and indicates the target, and facilitates aiming the gun. As with any battery-operated device, these types of sights are susceptible to loss of power, whether due to expiration of battery life, damage, or conventional wear-and-tear. Unpowered, these types of sights are of limited, or no use. With the present invention, there is no power source to be lost and render the device useless. As used here, by "reticle" we mean a mark, or network of marks, or the like, placed in the focal plane of an optical instrument to assist measurement or observation of the size or position of objects under observation. Typically, a reticle takes the form of a cross, or crosshairs.

The present invention is superior in practice compared to typical post type front sights as well. With the traditional post type sight, the front sight covers the lower portion of the shooter's field of vision and obscures the target, thus confusing point of aim. The present sight utilizes a transparent, or optically clear, lens 8, specifically to provide an unobscured view of the entire target, yet still providing a visually bright sighting point.

In addition, the present sight works differently that aperture type sights in that with aperture sights, the visual focus is on the concentricity of the front and rear sights, whereas with the present sight, the focus is on the sight dot of the fiber optic rod 9. This sight also allows the same benefit regardless of the design of the target whether it is a round decimal type target or a silhouette type target.

The size of the lens disc 8 is not critical. However, there are some factors one needs to keep in mind with the present invention. The lens 8 must be sufficiently thick to adequately hold the rod 9 in place. Too thin and the rod 9 will pitch and/or yaw out of alignment with the shooter's eye, no longer appearing as a simple dot; such alignment is critical to the proper operation of the device. Moreover, an exceedingly thin lens 8 is weaker and more likely to break during removal/replacement than a thicker lens. If the lens 8 is too thick, cost of manufacturing increases; replacement of the rod 9 is more difficult; less light is transmitted through the lens 8, and the field of view is adversely affected. In addition, a thicker lens 8 means a heavier sight 10, which can adversely affect overall weapon balance and hamper aiming. The lens 8, and by necessity the ring 3, must also be of sufficient diameter to allow the user's fingers and/or thumbs to fit and secure the lens 8 into the ring 3. If the diameter is too small, the user's digits will not fit in the ring 3, and thus special tools would be required to replace the lens—defeating one of the primary purposes of the sight, namely replacement without the use of tools.

The size of the fiber optic member 9 is not critical. However, as with the lens 8, there are some factors one needs to keep in mind with the present invention. A longer rod 9 allows for the capture of more ambient light, which is desired. If the rod 9 is too long, it may flex and no longer appear as a simple dot; it may even be susceptible to breaking. The diameter of rod 9 needs to be large enough for a longer rod 9 to resist flexing, but if it is too large, the rod 9 will obscure the target. If the diameter of rod 9 is too small, insufficient light will be gathered and transmitted for the sight 10 to function properly. Moreover, a very thin rod 9 would be too fragile to be practicable, as repeated replacement would likely lead to breakage.

The sight 10 is adjustable for height. This feature allows for precise zeroing and it retains position to maintain consistency in that zero. In this case, to zero a rifle is to set the distance at which the bullet will strike exactly where the sight or reticle is aimed, not accounting for wind or elevation differences. The zero point is a point of preference for the shooter. Typical combat rifles or hunting rifles are usually zeroed at 100 yards. Also a benefit of this adjustability, a user could use the same system for targets from virtually point-blank to the ballistic limits of the firearm.

Figure 4:
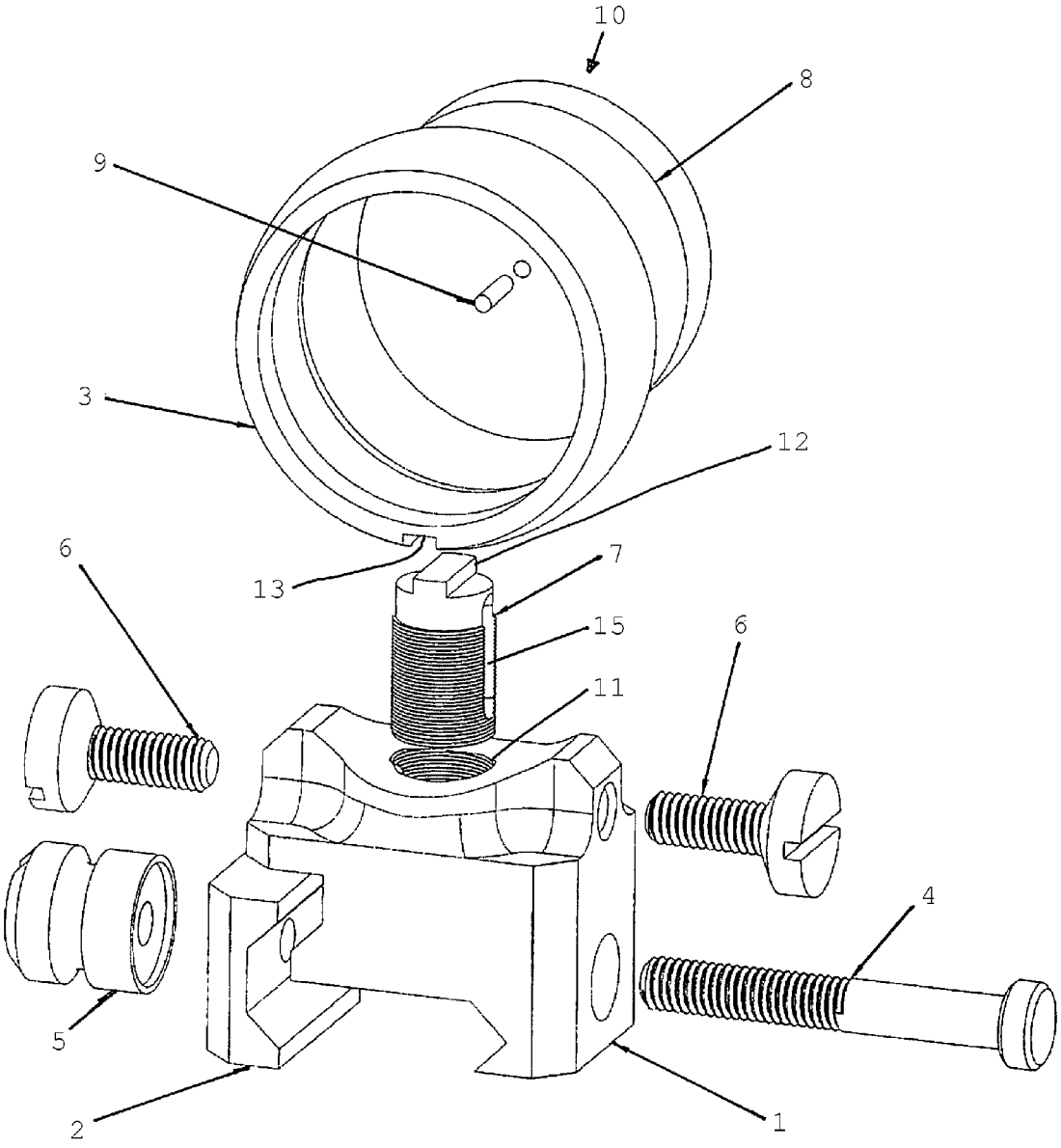
FIG. 4 is an exploded view of the sight, showing various components.

To adjust, the shooter first loosens the thumbscrews 6 that lock the sight in position. Next, the shooter rotates or turns the sight (thus "screwing" or "unscrewing" the sight) to the desired height adjustment. This adjustment occurs in 180-degree increments. Ball detents (not shown) slide into channel 15 (FIG. 4) located on opposite sides of the sight screw 7. The ball detents only slide into position when aligned with channel 15, and upon each 180° rotation of the screw 7. Because the ring 3 is symmetrical and appears identical when viewed from either side, each 180° adjustment setting is indistinguishable from the previous setting, other than in height. To finish, once the user is satisfied with the new adjusted height, the user then simply retightens the thumbscrews 6 to lock the ring in place.

The weight and view problems, discussed above, associated with iron sights and conventional telescopic sights have been overcome with the present front firearm sight invention. The invention does not add significantly to the weight of the firearm. This invention also does not significantly raise the line of sight above the bore axis more than would be the case with iron sights and there is also no problem with the sight striking the eye of the shooter. The shooter retains full peripheral vision as well. With the present invention it is possible to accurately and rapidly sight a firearm such as a rifle, shotgun, or carbine or other small arm firearm more easily and more quickly than with previous firearm sights. This invention can also easily be placed on and removed from a wide variety of small arm firearms without requiring modification of the firearm.

Although the invention has been described in detail with reference to particular examples and embodiments, the examples and embodiments contained herein are merely illustrative and are not an exhaustive list. Variations and modifications of the present invention will readily occur to those skilled in the art. The present invention includes all such modifications and equivalents. The claims alone are intended to set forth the limits of the present invention.

What is claimed is:

1. A firearm sight comprising a generally circular sight support ring surrounding and removably holding a transparent generally circular lens, and a scintillating fiber optic member embedded within said circular lens, a means for mounting said circular sight support ring to a firearm, and a means of adjusting said circular support ring in relation to said means for mounting said ring to a firearm.

2. The firearm sight of claim 1 wherein said lens is colorless.

3. The firearm sight of claim 1 wherein said lens is tinted with a color.

4. The firearm sight of claim 1 wherein said generally circular sight support ring comprises a retaining ring.

5. The firearm sight of claim 1 wherein said lens is removable.

6. The firearm sight of claim 5 wherein said lens is colorless or colored and is interchangeable.

7. The firearm sight of claim 1 wherein said lens is constructed of materials selected from the group consisting of glass, tempered glass, extra low dispersion glass, gorilla glass, acrylic, polycarbonate, and combinations thereof.

8. The firearm sight of claim 1 wherein said mounting means further comprises at least one clamp for clamping said optical sight and mount to a muzzle end portion of a barrel of said firearm.

9. The firearm sight of claim 1 wherein said means of adjusting said circular support ring comprises a threaded screw.

10. The firearm sight of claim 9 wherein said threaded screw is held in position using ball-detents.

11. The firearm sight of claim 9, wherein said threaded screw is further held in position using thumb screws.

12. The firearm sight of claim 1 wherein said means of adjusting said circular support ring facilitates zeroing the firearm.

13. The firearm sight of claim 1 wherein said fiber optic member is centrally embedded within said circular lens.

14. The firearm sight of claim 1 wherein said lens has a cylindrical shape, front and back faces, and a diameter greater than the thickness of the lens.

15. A firearm sight comprising a circular ring, having a slot at its base, surrounding and holding a transparent circular lens, said lens having a transparent, cylindrical fiber optic rod embedded at its center, a mounting base comprising a sight clamp base and sight clamp bar, wherein said sight clamp bar mates with said sight clamp base, wherein said sight clamp base has a threaded sight screw hole on its top, a threaded clamp stud connecting said sight clamp base to said sight clamp bar, a clamp knob having interior threads to receive said clamp stud, a threaded sight screw, having a ridge, connecting said ring to said mounting base, said sight screw connecting to said mounting base via said threaded sight screw hole, and is further held in position in relation to the sight clamp base via two adjustment screws aligned perpendicularly to said sight screw, said sight screw connecting to said ring via said ridge, which mates with said slot.

* * * * *